US009993093B2

(12) United States Patent
Berry

(10) Patent No.: US 9,993,093 B2
(45) Date of Patent: Jun. 12, 2018

(54) HIGHLIGHTER TOOL FOR GREETING CARD DISPLAY

(71) Applicant: HALLMARK CARDS, INCORPORATED, Kansas City, MO (US)

(72) Inventor: Todd E. Berry, Kansas City, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 106 days.

(21) Appl. No.: 14/755,459

(22) Filed: Jun. 30, 2015

(65) Prior Publication Data

US 2017/0000267 A1 Jan. 5, 2017

(51) Int. Cl.
*A47F 7/14* (2006.01)
*A47F 5/00* (2006.01)

(52) U.S. Cl.
CPC ..... *A47F 5/0068* (2013.01); *A47F 7/145* (2013.01); *A47F 2005/0075* (2013.01)

(58) Field of Classification Search
CPC ..... G09F 19/00; A47F 7/144; A47F 7/145; A47F 7/146
USPC ..... 211/135
See application file for complete search history.

(56) References Cited

U.S. PATENT DOCUMENTS 1,594,754 A * 8/1926 Reines ..... A47F 7/145 108/61
2,869,732 A * 1/1959 Ganz ..... A47F 5/005 211/55
3,139,186 A * 6/1964 George ..... A47F 7/144 211/184
3,285,424 A * 11/1966 Emery ..... A47F 7/145 108/60
3,298,538 A * 1/1967 Ganz ..... A47F 7/145 211/184
4,796,764 A * 1/1989 Hardy ..... G09F 1/10 211/184
4,905,845 A * 3/1990 Broeker ..... A47F 7/145 211/128.1
7,775,379 B2 8/2010 Hodge
7,987,998 B1 8/2011 Belk et al.
7,987,999 B2 * 8/2011 Weigand ..... A47F 5/0884 211/55
8,172,093 B1 5/2012 Belk et al.
8,307,998 B2 11/2012 Belk et al.
(Continued)

*Primary Examiner* — Stanton L Krycinski
(74) *Attorney, Agent, or Firm* — Shook Hardy & Bacon, LLP

(57) ABSTRACT

A highlighter tool for enhanced display of greeting cards on a store shelf is provided. The highlighter includes a display portion, one or more support members coupled to the display portion, and one or more receiving notches coupled to the display portion for receiving a portion of a shelf and supporting the highlighter. In one exemplary embodiment, the highlighter includes a first receiving notch, a first support member, and a left wall aligned and coupled with a left edge of the display portion, and a right receiving notch, a second support member, and a right wall aligned and coupled with a right edge of the display portion. The highlighter may comprise a first and a second half rotatably coupled with a center hinge, and left and right walls rotatably coupled to the respective first and second halves, allowing the highlighter tool to be folded into a compact configuration for storage.

19 Claims, 6 Drawing Sheets

(56) References Cited

U.S. PATENT DOCUMENTS

| | | | | |
|---|---|---|---|---|
| 8,540,091 | B2 * | 9/2013 | Kristensen | A47F 5/10 211/135 |
| 8,544,659 | B2 | 10/2013 | Belk et al. | |
| 9,119,489 | B2 * | 9/2015 | Buettner | A47F 7/145 |
| 2012/0091089 | A1 * | 4/2012 | Chen | A47F 5/114 211/135 |
| 2012/0318759 | A1 | 12/2012 | Buettner et al. | |
| 2014/0075794 | A1 | 3/2014 | Belk et al. | |

* cited by examiner

HIGHLIGHTER TOOL FOR GREETING CARD DISPLAY

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention generally relates to the displaying of greeting cards. More specifically, the present invention relates to a highlighter tool for enhancing the display of greeting cards on one or more rows of a greeting card display.

BACKGROUND

Positioning of consumer products on store shelves is critical for product promotion and sales. Products that are more visible and more accessible to passing consumers are much more likely to be purchased. Oftentimes, when greeting cards are sold in stores, the cards are positioned on shelves such that they are at least partially obscured and can difficult to see by passing shoppers. As a result, the cards are "lost" to the eyes of consumers within the busy store shelves. This results in fewer purchases. Consequently, an independent structure that can be attached to one or more rows of a greeting card display to enhance the appearance of greeting cards contained therein is needed. The aspects described in this disclosure solve this need, among others.

SUMMARY

This summary is provided to introduce a selection of concepts in a simplified form that are further described below in the detailed description section. This summary is not intended to identify key or essential features of the claimed subject matter, nor is it intended to be used as an aid in determining the scope of the claimed subject matter. The scope of the invention is defined by the claims.

In general, embodiments of the present invention provide a highlighter tool for enhancing the display of greeting cards. In a broad aspect, the highlighter tool has a display portion for surrounding one or more greeting cards, at least one receiving notch configured to receive a portion of a shelf or row of a greeting card display fixture, and a first support member coupled to the display portion at a first location and extending from the first location to a distal end. In one embodiment, the highlighter tool includes a first support member with a first receiving notch coupled to a left edge of the display portion and a second support member with a second receiving notch coupled to a right edge of the display portion. Each receiving notch is located in a rearward edge of its respective support member. Additionally, each support member may include one or more bends providing a directional change in the support member, to help conform the support member to the shape of one or more rows of a standard greeting card display fixture.

In another aspect, the highlighter tool includes a display portion for surrounding one or more greeting cards, first and second receiving notches coupled to the display portion, a left wall and a right wall coupled to respective left and right edges of the display portion, and first and second support members coupled to the display portion at respective first and second locations and extending downward to respective distal ends, wherein each of the support members comprises an extension of at least a portion of the respective left and right walls. The walls may be perpendicular to the display panels, removably coupled to the respective left and right edges of the display portion, and/or rotatably or adjustably coupled to the edges of the display portion to allow adjustment of the angle of each support members relative to the display portion, helping to conform the shape of the highlighter to the shape of a greeting card display fixture. The highlighter tool may include receiving notches that are removable, adjustable, or selectively repositionable at different locations, or receiving notches that are simply formed from indentations in the display portion, the left or right walls, and/or the first and second support members.

In another aspect, the highlighter tool comprises a display portion having a top edge, a bottom edge, a left edge, a right edge, a forward-facing side, and a rearward-facing side, the display portion also having cut-out sections. The highlighter tool may further comprise a left wall coupled to the left edge of the display portion, a right wall coupled to the right edge of the display portion, and first and second receiving notches, the first and second receiving notches configured to receive a shelf and support the highlighter, the first and second receiving notches coupled to the respective left and right walls. The highlighter tool further comprises a left support member coupled to the left wall and extending downward to a distal end, and a right support member coupled to the right wall and extending downward to a distal end. The first and second support members may also comprise an extension of at least a portion of the respective left and right walls.

In a second embodiment, the highlighter further includes a dividing portion oriented along an approximate vertical midline of the display portion. The dividing portion separates the display portion into a first half and a second half which are on opposite sides of the dividing portion. A center hinge may be positioned in the dividing portion, the hinge rotatably coupling the first and second halves. In this regard, the first and second halves may be rotated and folded flat against each other, forming a first compact arrangement of the highlighter. In a variation of the second embodiment, the left and right walls may additionally be rotatably coupled to the left and right edges of the display portion with left and right hinges. In this regard, the left and the right walls may configured to fold inward flat against the respective first and second halves of the display portion, and the first and second halves may be folded about the center hinge flat against each other, forming a compact, stacked arrangement of the highlighter tool for convenient storage. The left and right hinges and/or walls may be offset or of different lengths to allow the first and second halves to lay flat against each other.

The terms "highlighter," "highlighter tool," "highlighter device," and "highlighter display" may be used interchangeably in this disclosure.

BRIEF DESCRIPTION OF THE SEVERAL VIEWS OF THE DRAWINGS

The present invention is explained in more detail with reference to the embodiments illustrated in the attached drawing figures, in which like reference numerals denote like elements, wherein.

DETAILED DESCRIPTION

The present invention, in its simplest terms, may be referred to as a "highlighter tool," as it "highlights" or "draws attention to" the greeting cards it surrounds. The highlighter tool is designed to hold or surround one or more greeting cards for presentation on a store shelf or greeting card display rack, drawing attention to the greeting cards and, subsequently, making the greeting cards more likely to be purchased. While various embodiments, features, and arrangements of the highlighter tool are described herein, the scope of the invention is not limited to the embodiments described or shown in the figures, as would be understood by one having ordinary skill in the art.

Figure 1:
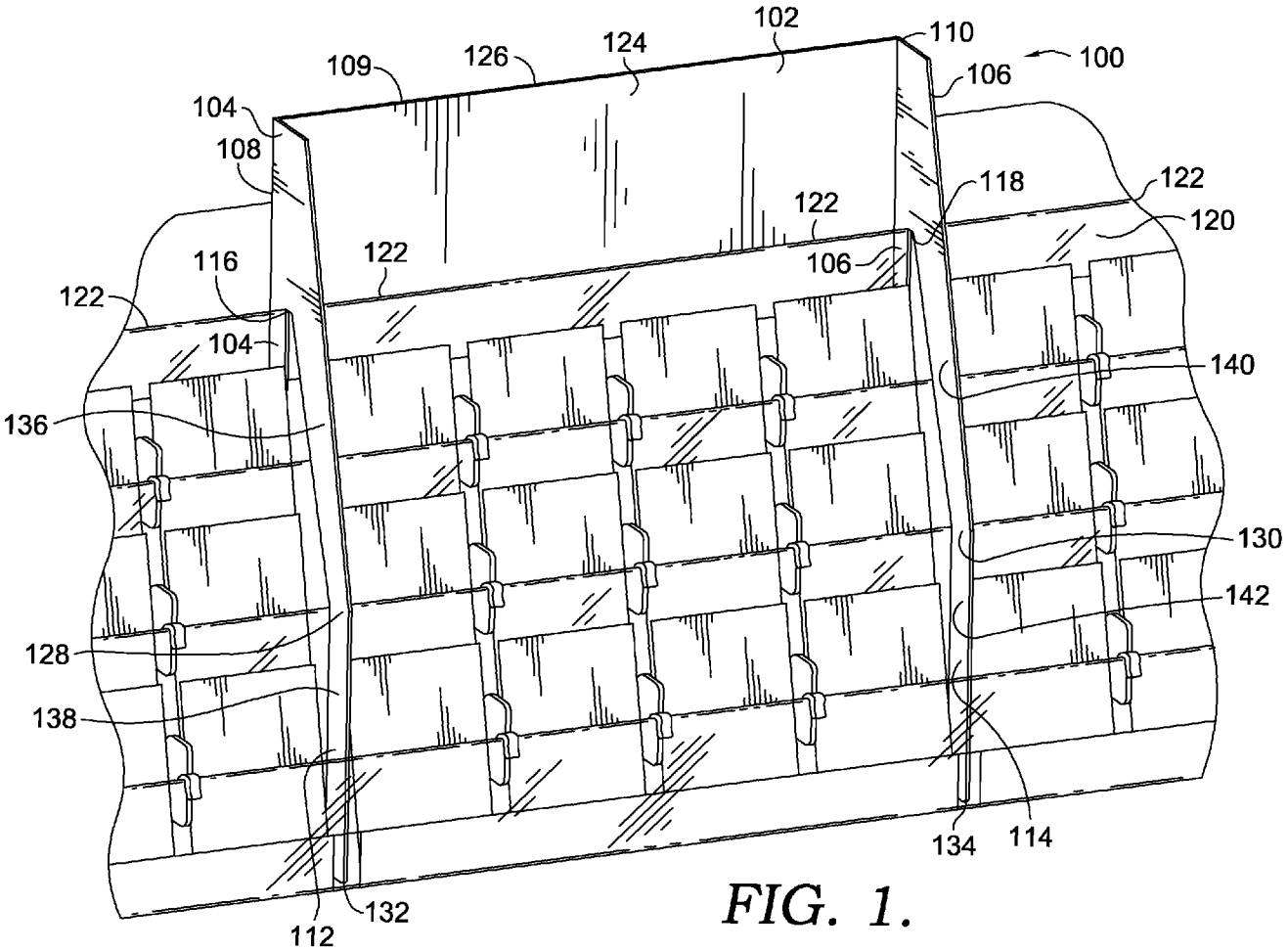
FIG. 1 depicts a fragmentary front perspective view of a first embodiment of a highlighter tool in accordance with an aspect of the present invention, the highlighter tool positioned on a display rack.
Figure 2:
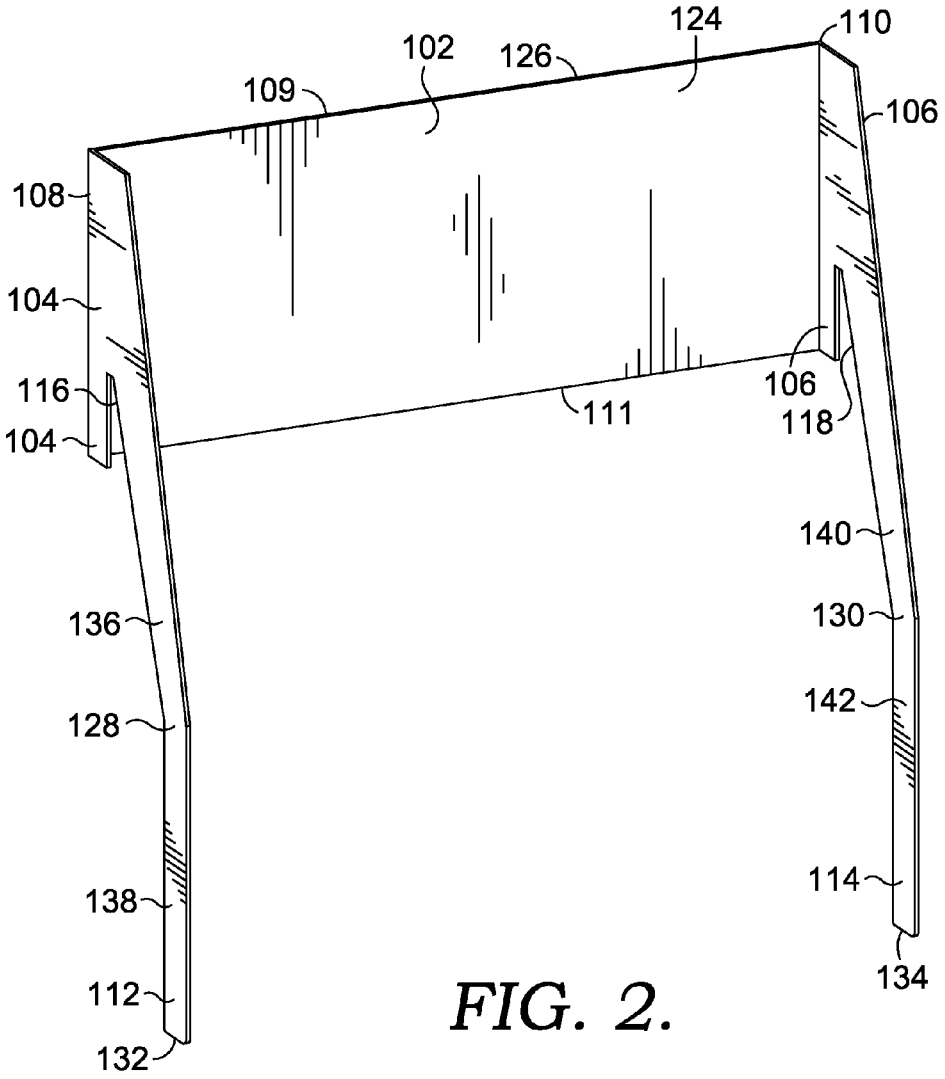
FIG. 2 depicts a front perspective view of the highlighter tool of FIG. 1.
Figure 3:
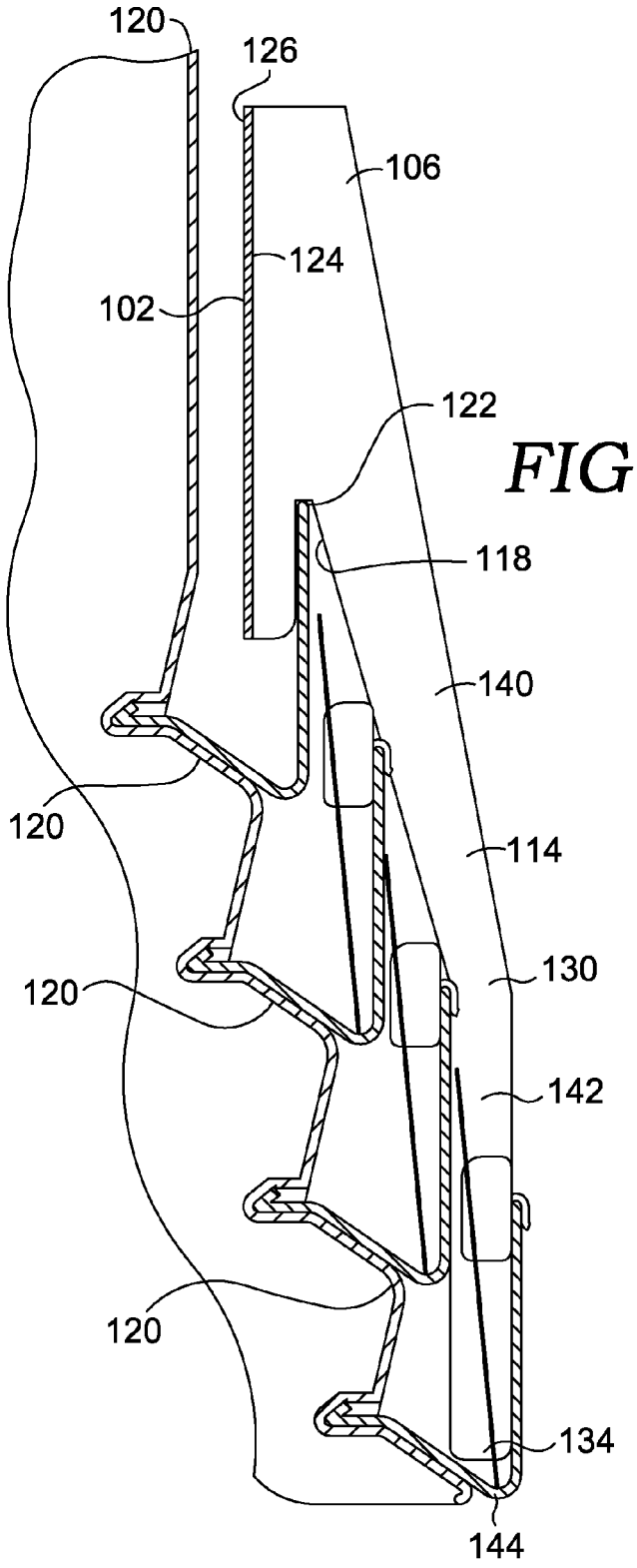
FIG. 3 depicts a fragmentary cross-sectional side elevation view of the highlighter tool depicted in FIG. 1 in use on a display rack.

FIGS. 1-3 depict a first embodiment of the highlighter tool 100. The first embodiment 100 generally includes a display portion 102 spacing apart a left wall 104 and a right wall 106 that are coupled to respective left and right edges 108, 110 of the display portion 102. A first support member 112 is coupled to or a part of the left wall 104, and a second support member 114 is coupled to or a part of the right wall 106. A first receiving notch 116 is formed in, coupled to, or positioned proximate to the left wall 104 between the display portion 102 and the first support member 112. Similarly, a second receiving notch 118 is formed in, coupled to, or positioned proximate to the right wall 106 between the display portion 102 and the second support member 114. In this regard, the receiving notches 116, 118 are defined in a space between the respective walls 104, 106 and each respective support member 112, 114. The left wall 104, the first support member 112, and the first receiving notch 116 are generally aligned along a left edge 108 of the display portion 102. Similarly, the right wall 106, the second support member 114, and the second receiving notch 118 are generally aligned along the right edge 110 of the display portion 102. Further, they may be integrally formed, as depicted in the illustrated embodiment, or they may be separate and coupled together.

FIG. 1 depicts a perspective view of the highlighter tool 100 positioned on a shelf or row 120 of a display rack in a use position, in accordance with an aspect of the present invention. The highlighter tool 100 is positioned upright on the greeting card shelf 120, with the first and the second receiving notches 116, 118 resting on a vertical portion or front wall 122 of the greeting card shelf 120. A first forward-facing panel 124 of the display portion 102 faces outward towards a shopping area, and a second rearward-facing panel 126 of the display portion 102 faces inward away from the shopping area. The first receiving notch 116 is positioned in, or shaped from, a junction between the left wall 104 and the first support member 112, and the second receiving notch 118 is positioned in, or shaped from, a junction between the right wall 106 and the second support member 114. The receiving notches 116, 118 may be an integrated part of the highlighter tool 100, or may be separately attachable pieces, depending on the desired configuration, adjustability, and break-down options. In FIG. 1, each support member 112, 114 comprises an extension, extrusion, or projection of at least a portion of the respective walls 104, 106. The panels generally comprising the walls 104, 106 and the support members 112, 114 are perpendicular to the display portion 102 and cooperatively define a box-type arrangement of the highlighter tool 100.

The first and second support members 112, 114 generally extend downward from the respective left and right walls 104, 106 of the display portion 102. The first and second support members 112, 114 are coupled to the left and right walls 104, 106 at respective first and second locations, which may be anywhere on or proximate the respective walls 104, 106, the edges 108, 110, or the display portion 102. These locations are not clearly defined or established as individual locations, but generally comprise the area of and around the left and right walls 104, 106 and the receiving notches 116, 118. The support members 112, 114 include respective first and second bends 128, 130, which provide an angular change of direction in the support members 112, 114. The support members 112, 114 provide support for the display portion 120, preventing axial rotation or tipping of the highlighter tool 100 on the shelf 120. The first bend 128 and the second bend 130 each change the downward angle of the support members 112, 114, allowing the support members 112, 114 to conform to the shape of the shelf 120. A first distal end 132 of the first support member 112 and a second distal end 134 of the second support member 114 sit within a lower row or shelf 120 of the display fixture, helping to secure the highlighter 100 in place against the fixture. Additionally, the first and second support members 112, 114 may be coupled to the greeting card shelf 120 with clips to further secure the highlighter in place against the shelf 120 (this is contemplated, but not depicted in FIG. 1).

Further in FIG. 1, the first support member 112 includes a first length 136 and a second length 138 separated by the first bend 128. The second support member 114 includes a first length 140 and a second length 142 separated by the second bend 130. The first and the second lengths 136, 138 of the first support member 112 are angled relative to each other, and the first and the second lengths 140, 142 of the second support member 114 are angled relative to each other, to allow the support members 112, 114 to conform to the shape of the shelf 120. Also, the first forward-facing panel 124 of the display portion 102 may include one or more ledges or holders (contemplated but not shown in FIG. 1) for receiving and holding greeting cards or similar merchandise for presentation or signage.

FIG. 2 depicts the highlighter tool 100 in isolation. The display portion 102 generally comprises a top edge 109, a bottom edge 111, a left edge 108, and a right edge 110. The first and second notches 116, 118 are formed between the left wall 104 and the first member 112 and the right wall 106 and the second member 114, respectively, and are configured to receive a vertical portion 122 of the shelf 120. The receiving notches 116, 118 may be at least ½ inch deep and at least ½ wide in a portion of the depth of each notch 116, 118, and may form an inverted V-shaped indentation, as shown in FIG. 2, for easy placement on a store shelf.

FIG. 3 depicts a cross-sectional view of a traditional greeting card display rack having a plurality of rows or shelves 120 with the highlighter tool 100 of FIG. 1 positioned on a shelf 120, in accordance with an aspect of the present invention. The positioning and securement of the highlighter 100 on the shelf 120 is more clearly depicted. FIG. 3 shows the right side of the highlighter 100 including the display portion 102, the right wall 106, and the second support member 114, with the second receiving notch 118 receiving the vertical portion 122 of the greeting card shelf 120. The second length 140 of the second support member 114 extends from the right wall 106 at an angle downward to the bend 130. This allows the second member to reach across the angled portions of the shelves 120. The second length 142 of the second support member 114 extends downward from the bend 130 to the distal end 134 of the second support member 114, the distal end 134 resting in an opening 144 in a lower shelf 120.

Figure 4:
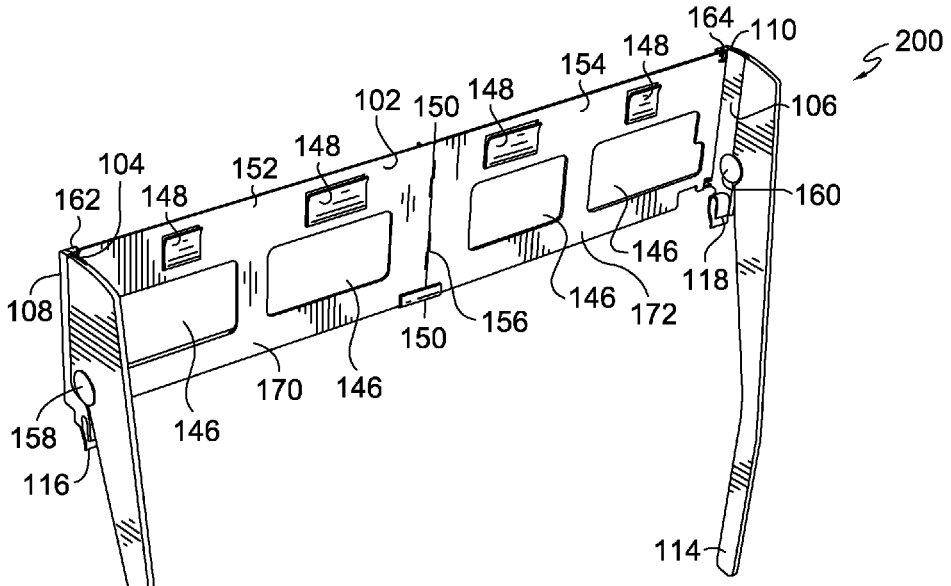
FIG. 4 depicts a front perspective view of a second embodiment a the highlighter tool in accordance with an aspect of the present invention, the highlighter tool including multiple pieces rotatably coupled to each other with hinges to allow the highlighter tool to be folded together to form a collapsed, compact arrangement.
Figure 5:
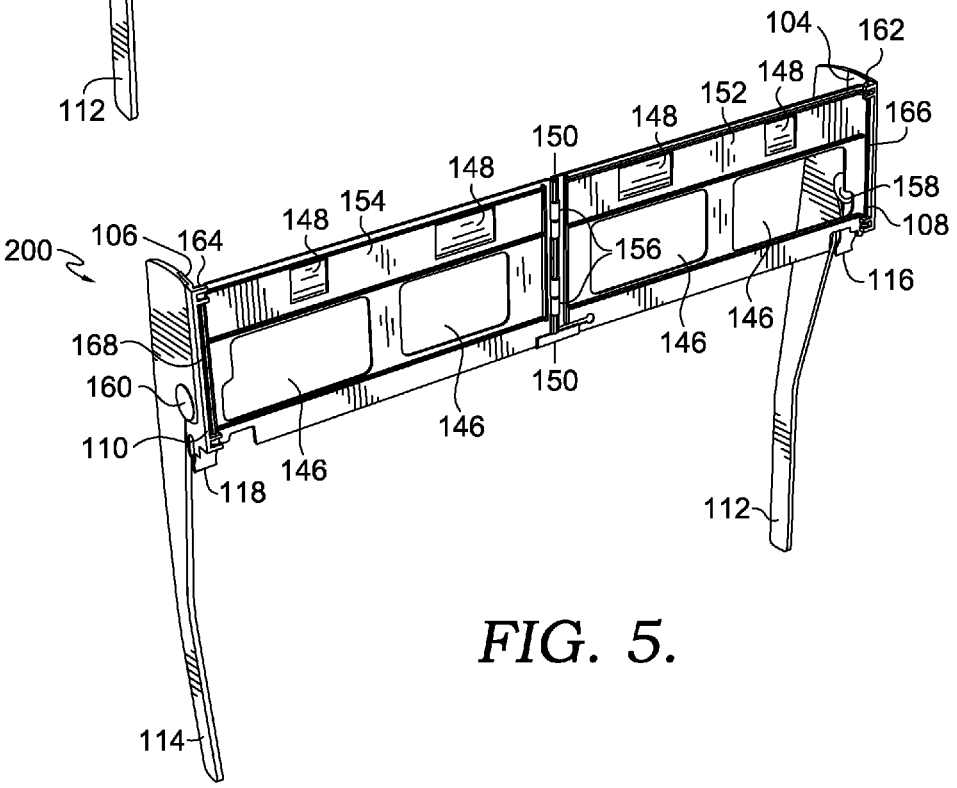
FIG. 5 depicts a rear perspective view of the highlighter tool of FIG. 4.
Figure 6:
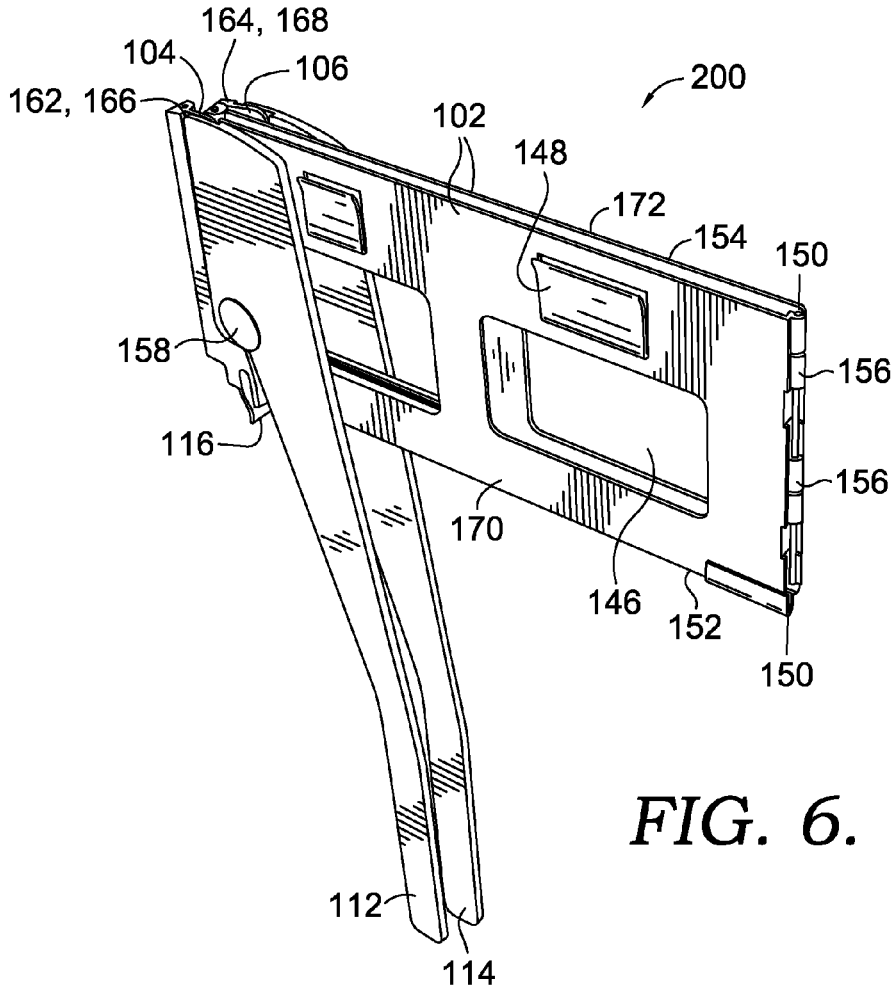
FIG. 6 depicts a front perspective view of the highlighter of FIG. 4 in a collapsed arrangement for storage, in accordance with an aspect of the present invention.

FIGS. 4-8 illustrate a second embodiment of a highlighter tool 200 featuring a multi-part construction with sections rotatably coupled to each other via hinges, thereby allowing the highlighter tool to be folded into a compact arrangement for storage. FIGS. 4 and 5 depict front and rear perspective views of the highlighter tool 200, respectively. In this embodiment, the display portion 102 of the highlighter 200 includes cut-out sections 146 to reduce weight and material in the highlighter 200. It also includes clips 148 for holding cards, merchandise, and/or signs, among other things. A dividing portion 150 is shown extending along a vertical approximate midline of the display portion 102. The dividing portion 150 separates the highlighter 200 into a first half 152 and a second half 154, and includes a center hinge 156 that rotatably couples the first half 152 and the second half 154, allowing the first and the second halves 152, 154 to rotate about the center hinge 156 and fold flat against each other, as depicted in FIG. 6. The central hinge 156 may allow rotation in one or both directions, in various embodiments.

FIGS. 4 and 5 further depict the highlighter 200 with left and right dividing portions 162, 164 proximate the respective left and right edges 108, 110 of the display portion 102. The dividing portions 162, 164 separate the left and right walls 104, 106 from the respective left and right edges 108, 110. Additionally, a left hinge 166 rotatably couples the left wall 104 to the left edge 108 of the display portion 102 in the left dividing portion 162, and a right hinge 168 rotatably couples the right wall 106 to the right edge 110 of the display portion 102 in the right dividing portion 164. In this aspect, the left and right walls 104, 106 can be folded inward and flat against the respective first and second halves 152, 154 of the display portion 102. After folding the left and right walls 104, 106 flat against the respective first and second halves 152, 154, the first and second halves 152, 154 of the display portion 102 may be rotated about the center hinge 156, bringing the first and the second halves 152, 154 flat against each other, as depicted in FIG. 6. This forms a compact, collapsed arrangement of the highlighter 200 for storage.

FIGS. 4 and 5 also depict the first support member 112 being rotatably coupled to the left edge 108 of the display portion 102 with a first rotating mechanism 158, and the second support member 114 being rotatably coupled to the right edge 110 of the display portion 102 with a second rotating mechanism 160. The first and second rotating mechanisms 158, 160 allow the support members 112, 114 to rotate axially in relation to the display panel 102, allowing the support members 112, 114 to adjust to the angle of a shelf on which the highlighter 200 is positioned.

Figure 7:
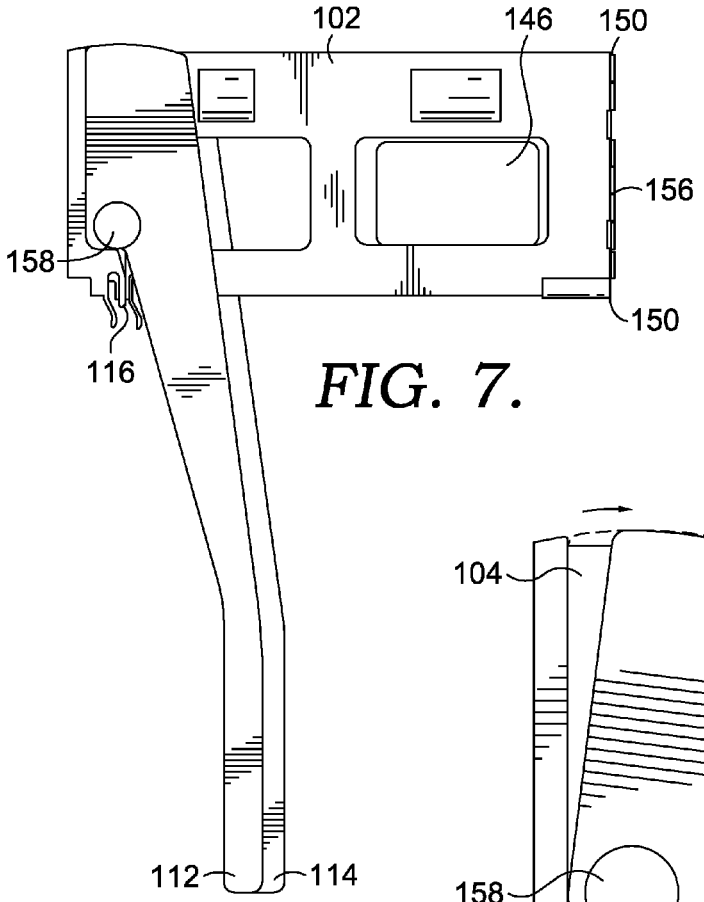
FIG. 7 is a front elevation view of the highlighter tool of FIG. 6.

FIG. 6 depicts a perspective view of the highlighter 200 of FIGS. 4-5 in a collapsed configuration for storage, in accordance with an aspect of the present invention. In FIG. 6, the first and second halves 152, 154 of the highlighter 200 have been folded flat against each other about the central hinge 156. Additionally, the left and right walls 104, 106 have been folded inward about the respective left and right hinges 166, 168 to lay flat against outer facing sides 170, 172 of the respective first and second halves 152, 154 of the folded display panel 102. The support members 112, 114 are aligned side-by-side, such that the entire highlighter 200 is in a collapsed configuration for easy storage. The first and second dividing portions 162, 164 and corresponding left and right hinges 166, 168 are offset in the illustrated embodiment to allow the first and second halves 152, 154 to get as close as possible. Optionally, additional devices or securement mechanisms may be used to secure the highlighter 200 in a closed configuration so that the support members 112, 114 and first and second halves 152, 154 do not swing open (e.g., a strap, Velcro®, a male-female connector, etc.). FIG. 7 depicts a side elevation view of the highlighter 200 depicted in FIGS. 4-6 in the collapsed configuration for storage, and more clearly shows the alignment of the first and second halves 152, 154 and the support members 112, 114.

Figure 8:
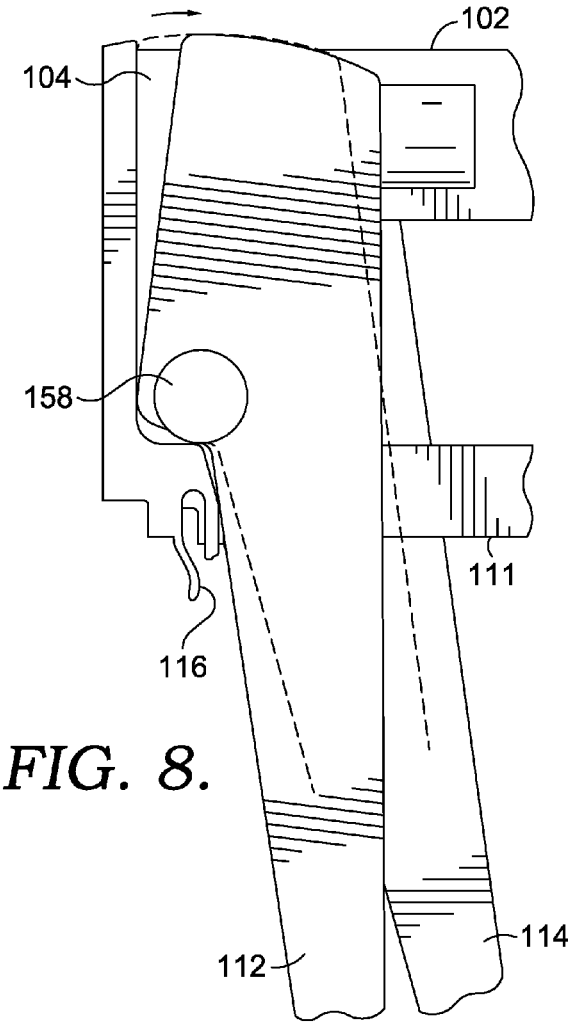
FIG. 8 is an enlarged, fragmentary view of the highlighter tool of FIG. 7, illustrating rotation of a support member relative to the display portion, in accordance with an aspect of the present invention.

FIG. 8 is an enlarged, fragmentary view of the highlighter tool 200 of FIG. 7, showing permitted rotation of the support member 112 relative to the display portion 102, in accordance with an aspect of the present invention. FIG. 8 shows how the first support member 112 is movably/rotatably coupled to the left wall 104 with the rotation mechanism 158. By allowing rotational movement of the support members 112, 114 relative to the display portion 102 (in this case, roughly relative to the bottom edge 111 of the display portion), the angle of the support members 112, 114 may be changed to rows or shelves of different depths and heights.

Embodiments of the present invention have been described with the intent to be illustrative rather than restrictive. It should be noted that while the invention has been described and illustrated in the context of gift cards and greeting cards, it is not so limited. A merchandiser may display all types of merchandise, such as, but not limited to, stationery, invitations, books, journals, giftwrap, paper, folders, pictures, etc. Additionally, alternative embodiments will become apparent to those skilled in the art that do not depart from the scope of the invention. A skilled artisan may develop alternative means of implementing the aforementioned improvements without departing from the scope of the present invention. It will be understood that certain features and subcombinations are of utility and may be employed without reference to other features and subcombinations and are contemplated as within the scope of the claims.

What is claimed is:

1. A highlighter tool for drawing attention to merchandise displayed on one or more shelves, the highlighter tool comprising:

a display portion for positioning adjacent the merchandise to be highlighted, the display portion comprising a top edge, a bottom edge, a left edge, a right edge, a forward-facing side, and a rearward-facing side;

a first side wall coupled to the left edge of the display portion;

a second side wall coupled to the right edge of the display portion;

a first support member coupled to the first side wall of the display portion at a first location and extending from the first location to a distal end;

a second support member coupled to the second side wall of the display portion at a second location and extending from the second location to a distal end, wherein the first side wall and the second side wall are spaced apart by the display portion;

a first receiving notch positioned intermediate the first side wall and the first support member; and a second receiving notch positioned intermediate the second side wall and the second support member, wherein the first receiving notch and the second receiving notch are each configured to receive a portion of the one or more shelves.

2. The highlighter tool of claim 1, wherein the display portion is foldable about a dividing portion, the dividing portion including a hinge.

3. The highlighter tool of claim 2, wherein the display portion includes one or more cut out sections.

4. The highlighter tool of claim 3, wherein each of the first and second receiving notches is one of an integrated part of the highlighter tool and a separately attached piece of the highlighter tool.

5. The highlighter tool of claim 4, wherein the first support member, the first receiving notch, and the first side wall are aligned and coupled with the left edge of the display portion, and wherein the second support member, the second receiving notch, and the second side wall are aligned and coupled with the right edge of the display portion.

6. The highlighter tool of claim 5, wherein the first and the second support members each include a bend.

7. The highlighter tool of claim 6, wherein each bend separates the respective first and second support members into a first length and a second length, wherein the first length extends from the respective first or second location to the respective bend, and the second length extends from the respective bend to the respective distal end.

8. The highlighter tool of claim 1, wherein the first and second side walls are perpendicular to the display portion.

9. The highlighter tool of claim 1, wherein the first and second receiving notches are each removable.

10. The highlighter tool of claim 1, wherein the first side wall and the second side wall extend perpendicular outward from the forward-facing side of the display portion.

11. The highlighter tool of claim 1, wherein the display portion is rectangular in shape.

12. A highlighter device for drawing attention to merchandise displayed on one or more shelves, the highlighter device comprising:

a display portion comprising a top edge, a bottom edge, a left edge, and a right edge, the display portion for positioning behind the merchandise;

first and second receiving notches coupled to the display portion and configured to receive at least a portion of the one or more shelves;

a first side wall and a second side wall coupled to the respective left and right edges of the display portion;

first and second support members coupled to the display portion at respective first and second locations and extending downward to respective distal ends, wherein each of the first and second support members comprises an extension of at least a portion of the respective left and right walls;

a dividing portion extending across the display portion that divides the highlighter device into a first portion and a second portion which are on opposite sides of the dividing portion; and a hinge located at the dividing portion that rotatably couples the first portion to the second portion at the dividing portion.

13. The highlighter device of claim 12, wherein the first support member, the first receiving notch, and the first side wall are aligned and coupled together, and wherein the second support member, the second receiving notch, and the second side wall are aligned and coupled together.

14. The highlighter device of claim 13, wherein each support member extends from the display portion downward at a first angle to a respective bend, and extends from the respective bend downward at a second angle to the respective distal end.

15. The highlighter device of claim 12, wherein the dividing portion extends vertically along a midline of the display portion.

16. The highlighter device of claim 15, wherein the first and the second support members are rotatably coupled to the display portion with respective first and second rotation mechanisms, such that the first and second support members can rotate axially relative to the bottom edge of the display portion.

17. The highlighter device of claim 15, wherein the first side wall is rotatably coupled to the left edge with a left hinge, wherein the second side wall is rotatably coupled to the right edge with a right hinge, and wherein the left and right side walls can be rotated about the respective left and right hinges to fold inward generally flat against the respective first and second portions of the highlighter device.

18. The highlighter device of claim 15, wherein the first and second portions can be folded together about the hinge flat against each other to form a compact arrangement.

19. A highlighter frame for partially surrounding and highlighting merchandise displayed on one or more shelves, the highlighter frame comprising:

a display portion having a top edge, a bottom edge, a left edge, a right edge, a forward-facing side, and a rearward-facing side;

a first side wall coupled to the left edge of the display portion;

a second side wall coupled to the right edge of the display portion;

first and second receiving notches, the first and second receiving notches configured to receive a portion of the one or more shelves to support the highlighter frame on the one or more shelves, the first and second receiving notches coupled to the respective first and second side walls;

a first support member coupled to the first side wall and extending downward to a distal end; and a second support member coupled to the second side wall and extending downward to a distal end, wherein the first receiving notch is positioned intermediate the first side wall and the first support member, wherein the second receiving notch is positioned intermediate the second side wall and the second support member, and wherein the display portion includes a hinge that rotatably couples a first portion and a second portion of the highlighter frame.

* * * * *